US008813676B2

(12) United States Patent
Fuller et al.

(10) Patent No.: US 8,813,676 B2
(45) Date of Patent: Aug. 26, 2014

(54) USER INTERFACE FOR A CONTROLLER

(75) Inventors: Mallory A. Fuller, Benton Harbor, MI (US); Rajat Shail, Saint Joseph, MI (US); Timothy E. Heater, Hartford, MI (US)

(73) Assignee: Whirlpool Corporation, Bentor Harbor, MI (US)

( * ) Notice: Subject to any disclaimer, the term of this patent is extended or adjusted under 35 U.S.C. 154(b) by 813 days.

(21) Appl. No.: 12/776,004

(22) Filed: May 7, 2010

(65) Prior Publication Data

US 2011/0271896 A1 Nov. 10, 2011

(51) Int. Cl.
*G05G 1/015* (2008.04)

(52) U.S. Cl.
USPC ..... 116/310; 116/286

(58) Field of Classification Search
CPC ..... G05G 1/10; G05G 1/12; G05G 1/015; G05G 1/105; D06F 39/005
USPC ..... 362/23, 26, 29–30, 23.22, 253, 555, 362/559, 311.02; 116/332, 62.1, 202, 116/286–288, 302, 304, 310, DIG. 5; 200/316–317
See application file for complete search history.

(56) References Cited

U.S. PATENT DOCUMENTS 1,566,069 A * 12/1925 Buchholz et al. ..... 116/257
2,161,310 A * 6/1939 Osborn ..... 334/32
2,285,374 A * 6/1942 Dohsmann et al. ..... 116/263
2,548,760 A * 4/1951 Allgeyer ..... 337/376
2,681,977 A * 6/1954 Ballard ..... 362/299
2,699,141 A * 1/1955 Gaguski ..... 116/332
2,701,286 A * 2/1955 Slate et al. ..... 200/316
2,713,103 A * 7/1955 Slate ..... 200/316
2,732,467 A * 1/1956 Slate ..... 200/316
2,742,015 A 4/1956 Hoyle
2,750,918 A * 6/1956 Willman ..... 116/310
2,763,231 A * 9/1956 Neugass ..... 116/332
2,831,453 A * 4/1958 Hardesty ..... 116/288
2,957,447 A * 10/1960 Pearce ..... 116/332
3,130,279 A 4/1964 Holzer
3,506,836 A 4/1970 Rueger
3,619,594 A * 11/1971 Morez ..... 362/140
3,864,561 A 2/1975 Spira et al.
3,968,356 A 7/1976 Martin
4,052,591 A 10/1977 Sekera, Jr. et al.
4,176,265 A 11/1979 Mobus et al.
4,215,647 A * 8/1980 Fukasawa ..... 116/286
4,218,726 A * 8/1980 Fukasawa et al. ..... 362/23
4,523,259 A * 6/1985 Dorsett et al. ..... 362/120

(Continued)

FOREIGN PATENT DOCUMENTS

CA 2733350 A1 9/2010
CN 1683664 A 10/2005

(Continued)

OTHER PUBLICATIONS

German Search Report for corresponding DE102011001435, Nov. 17, 2011.

*Primary Examiner* — R. A. Smith
*Assistant Examiner* — Tania Courson

(57) ABSTRACT

A user interface for a controller may include a panel having multiple indicia, a parameter selector configured to move relative to the multiple indicia, and an indicator to indicate which of the multiple indicia is selected by the selector.

19 Claims, 6 Drawing Sheets

(56) References Cited

U.S. PATENT DOCUMENTS

| | | | | |
|---|---|---|---|---|
| 4,583,151 | A * | 4/1986 | Nagel | 362/29 |
| 4,807,091 | A | 2/1989 | Obata | |
| 4,872,093 | A * | 10/1989 | Shimizu | 362/26 |
| 5,093,764 | A * | 3/1992 | Hasegawa et al. | 362/29 |
| 5,171,080 | A | 12/1992 | Bathurst | |
| 5,353,735 | A * | 10/1994 | Arai et al. | 116/286 |
| 5,570,596 | A | 11/1996 | Imai et al. | |
| 5,752,759 | A * | 5/1998 | Pizzo | 362/26 |
| 5,913,414 | A | 6/1999 | Pollock et al. | |
| 6,003,206 | A | 12/1999 | Hall et al. | |
| 6,019,493 | A * | 2/2000 | Kuo et al. | 362/335 |
| 6,224,221 | B1 * | 5/2001 | Glienicke | 362/23 |
| 6,249,375 | B1 * | 6/2001 | Silhengst et al. | 359/362 |
| 6,392,175 | B1 | 5/2002 | Bauer et al. | |
| 6,499,191 | B1 * | 12/2002 | Howie, Jr. | 16/441 |
| 6,565,223 | B2 * | 5/2003 | Liao et al. | 362/26 |
| 6,667,446 | B1 | 12/2003 | Schuberth et al. | |
| 6,733,146 | B1 | 5/2004 | Vastano | |
| 6,755,549 | B2 * | 6/2004 | Rogers et al. | 362/88 |
| 6,767,104 | B2 * | 7/2004 | Worrell | 362/26 |
| 6,860,224 | B2 * | 3/2005 | Snider | 116/310 |
| 6,862,482 | B2 | 3/2005 | Peterson et al. | |
| 7,014,330 | B2 | 3/2006 | Yokoyama et al. | |
| 7,036,188 | B1 | 5/2006 | Howie, Jr. | |
| 7,083,299 | B2 * | 8/2006 | Chapman | 362/188 |
| 7,205,495 | B2 | 4/2007 | Mazur | |
| 7,222,979 | B1 | 5/2007 | Popowich et al. | |
| 7,255,061 | B2 | 8/2007 | Denton | |
| 7,399,098 | B2 | 7/2008 | Nakamoto et al. | |
| 7,423,886 | B2 | 9/2008 | Nishimoto et al. | |
| 7,500,774 | B2 * | 3/2009 | Nishiyama et al. | 362/551 |
| 7,514,645 | B2 * | 4/2009 | Shahmuradyan | 200/564 |
| 7,780,325 | B2 * | 8/2010 | Collomb et al. | 362/551 |
| 7,928,859 | B1 * | 4/2011 | Li et al. | 340/815.78 |
| 8,178,805 | B2 * | 5/2012 | Larson et al. | 200/316 |
| 8,277,065 | B2 * | 10/2012 | Camarillo Fernandez et al. | 362/92 |
| 2004/0070990 | A1 * | 4/2004 | Szypszak | 362/555 |
| 2005/0265024 | A1 * | 12/2005 | Luk | 362/231 |
| 2005/0270779 | A1 | 12/2005 | Mazur | |
| 2006/0164397 | A1 | 7/2006 | Bruntz et al. | |
| 2010/0181174 | A1 | 7/2010 | Larson et al. | |

FOREIGN PATENT DOCUMENTS

| | | | |
|---|---|---|---|
| CN | 1715496 | A | 1/2006 |
| CN | 1749468 | A | 3/2006 |
| DE | 2357496 | A1 | 5/1975 |
| DE | 7911425 | U1 | 8/1979 |
| DE | 8702558 | U1 | 6/1987 |
| DE | 4204499 | A1 | 8/1993 |
| DE | 4232122 | A1 | 10/1994 |
| DE | 19819433 | C1 | 9/1999 |
| DE | 10236935 | A1 | 2/2004 |
| DE | 19655281 | B4 | 3/2005 |
| DE | 19655279 | B4 | 4/2007 |
| EP | 0172576 | A2 | 2/1986 |
| EP | 0517932 | A1 | 12/1992 |
| EP | 1427880 | B1 | 6/2004 |
| EP | 1627267 | B1 | 2/2006 |
| EP | 1939531 | A2 | 7/2008 |
| EP | 1995751 | A2 | 11/2008 |
| EP | 2051271 | A2 | 4/2009 |
| FR | 2593618 | A1 | 7/1987 |
| GB | 584163 | | 1/1947 |
| GB | 619842 | | 3/1949 |
| GB | 658829 | | 10/1951 |
| GB | 1434909 | | 5/1976 |
| GB | 1469235 | | 4/1977 |
| GB | 2151404 | A | 7/1985 |
| GB | 2193592 | A | 2/1988 |
| GB | 2279969 | A | 1/1995 |
| GB | 2376284 | A | 12/2002 |
| JP | 9082175 | A | 3/1997 |
| WO | 2007/043838 | A1 | 4/2007 |
| WO | 2008/138082 | A1 | 11/2008 |

* cited by examiner

USER INTERFACE FOR A CONTROLLER

BACKGROUND OF THE INVENTION

Home appliances are increasingly equipped with a greater number of user-selectable parameters. A typical appliance may have a controller that implements a number of pre-programmed cycles of operation having one or more user-selectable parameters. A user interface or control panel may be provided on the appliance for selecting or setting one or more of the user-selectable parameters, and may be coupled to the controller. The user-selectable parameters of the appliance may be represented by indicia on or near the user interface. The user interface may have a selector for selecting one or more of the indicia.

BRIEF DESCRIPTION OF THE INVENTION

The invention, in one aspect, relates to a parameter selector having a housing at least partially defining an interior; an illumination device that may be configured to emit light; a first transmission area that may transmit light to an exterior of the housing; and an optical element arranged with the first transmission area such that light emitted from the illumination device and passing through the first transmission area may form a discrete projection of light on a panel.

DESCRIPTION OF EMBODIMENTS OF THE INVENTION

Figure 1:
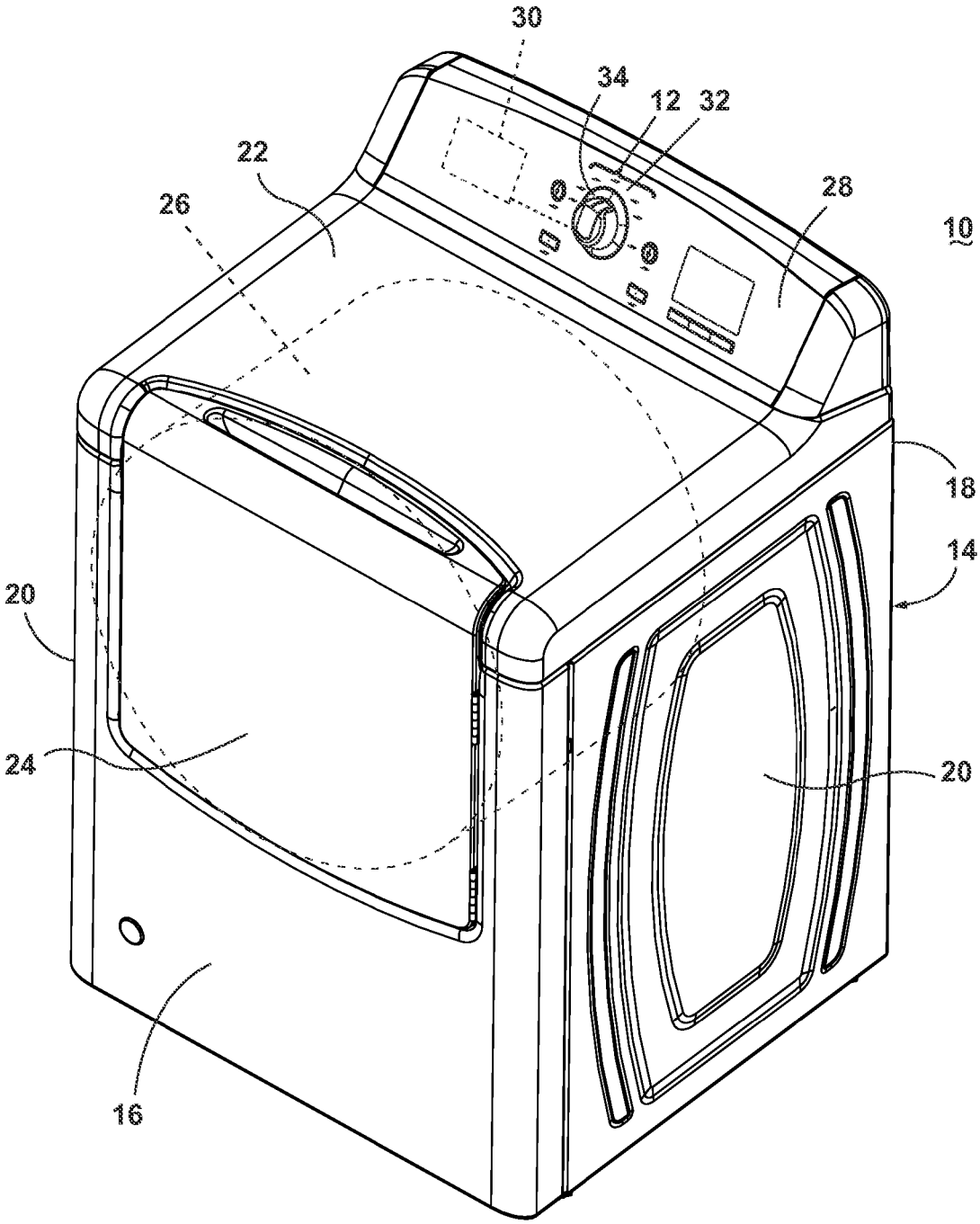
FIG. 1 is a perspective view of an appliance having a user interface according to one embodiment of the invention.

FIG. 1 is a perspective view of an appliance 10 having a user interface 12 according to one embodiment of the invention. As illustrated, the appliance 10 may be a washing machine, although the user interface 30 may be included on other types of appliances, non-limiting examples of which may include clothes dryers, dishwashers, refrigerators, freezers, conventional ovens, microwave ovens, stoves, and ranges. The user interface also may be used in environments other than appliances. The washing machine described herein may share many features of a traditional automatic washing machine, which will not be described in detail except as necessary for a complete understanding of the invention.

The appliance 10 may have a cabinet 14 defined by a front wall 16, a rear wall 18, and a pair of side walls 20 supporting a top wall 22. A door 24 may be hingedly mounted to the front wall 16 and may be selectively movable between opened and closed positions to close an opening in the front wall 16, which provides access to the interior of the cabinet 14. A treating chamber 26 may be disposed within the interior of the cabinet 14. The top wall 22 may support or be formed with a backsplash 28.

The appliance 10 may further have a controller 30 provided in the cabinet 14 or the backsplash 28 that implements a number of pre-programmed cycles of operation having one or more user-selectable parameters. The user interface 12 may be operably coupled with the controller 30 for selecting and/or setting one or more of the user-selectable parameters. The particular user-selectable parameters will vary depending on the appliance 10. For the washing machine illustrated in FIG. 1, examples of user-selectable parameters may include cycle type (such as a normal, power wash, hand wash, wrinkle control or heavy duty cycle), load size (such as a small, medium, or large load), and fabric color (such as whites or colors).

The user interface 12 may be provided on an exterior portion of the appliance 10, such as on the front wall 16 of the cabinet 14 or, as illustrated, on the backsplash 28. The user interface 12 may include a panel 32 and a parameter selector 34 that may be movable relative to the panel 32. As illustrated, the panel 32 may be integral with the backsplash 28. Alternately, the panel 32 may be a separate piece coupled with the backsplash 28.

Figure 2:
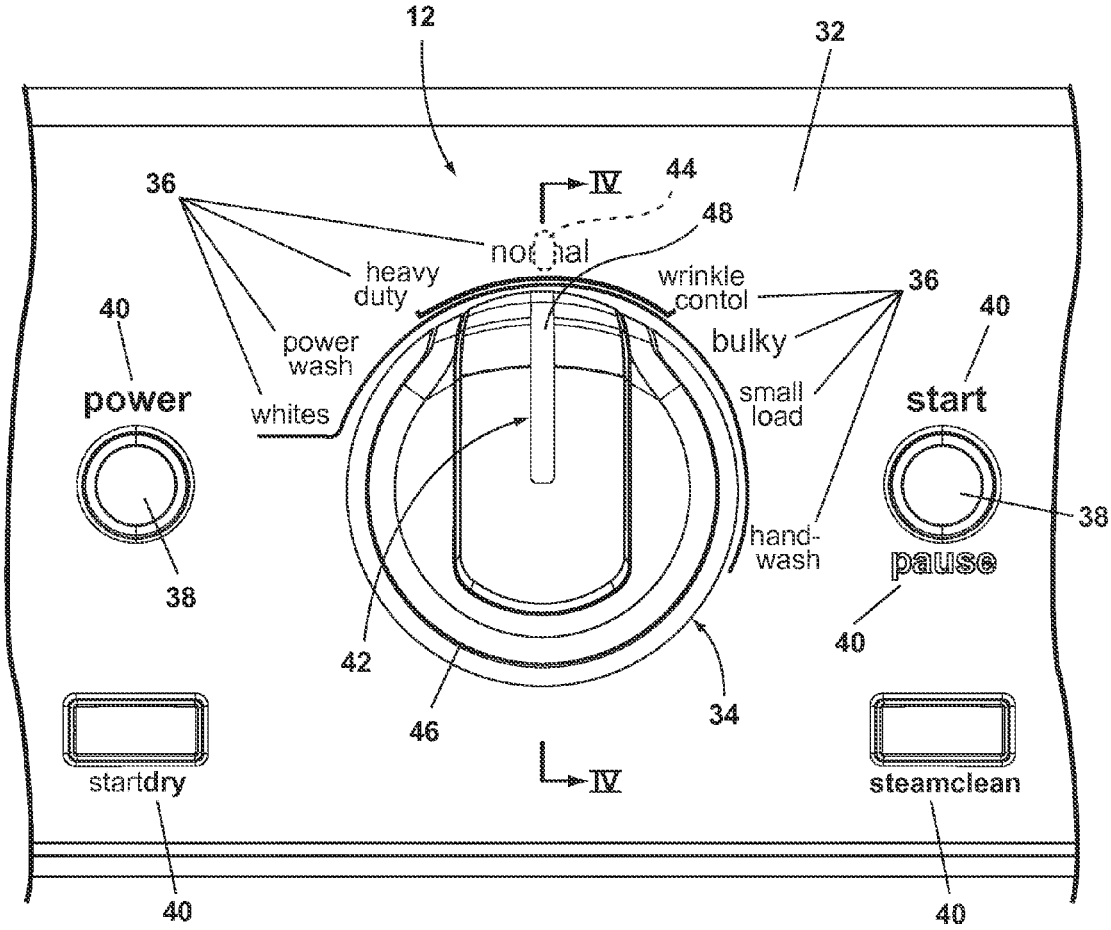
FIG. 2 is a front perspective view of the user interface of FIG. 1, the user interface having a parameter selector mounted on a panel.

FIG. 2 is a front perspective view of the user interface 12 of FIG. 1. The panel 32 may include multiple indicia 36 representing the user-selectable parameters. The parameter selector 34 may be configured to protrude from the panel 32 and move relative to the indicia 36 to select one of the indicia 36. As such, the indicia 36 may be arranged around the perimeter of the parameter selector 34 on the panel 32. In addition to the parameter selector 34, the user interface 12 may include additional buttons 38 for selecting and/or setting one or more of the user-selectable parameters indicated by additional indicia 40 on the panel 32. The user interface 12 may further include a light projector 42 that may be at least partially carried by the parameter selector 34 and which is operable to project a beam of light on the panel 32 to form a discrete projection of light 44 on the panel 32, with the projection of light 44 located on or near the indicia 36 corresponding to the parameter being selected.

As illustrated, the parameter selector 34 is shown as a knob which rotates relative to the panel 32. The knob 34 may include a housing 46 which may be mounted to the panel 32 in any manner suitable for rotatable movement of the knob 34. The parameter selector is not limited to a rotatable knob. Other selectors may be used.

Figure 3:
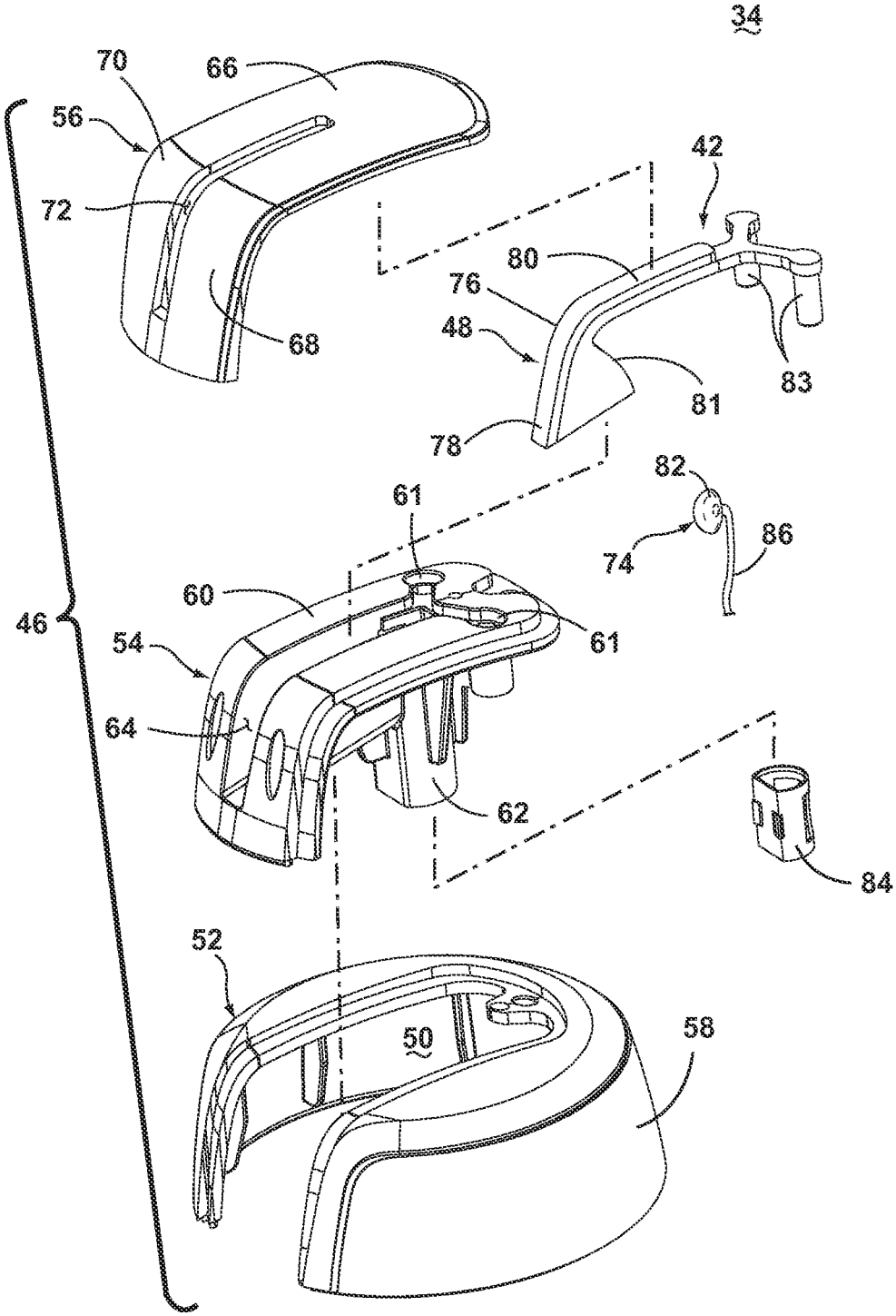
FIG. 3 is an exploded view of the parameter selector of FIG. 2.

FIG. 3 is an exploded view of the parameter selector or knob 34 of FIG. 2. The housing 46 may include a sub-housing 52, a projector support housing 54, and a top cap 56. The sub-housing 52 may include base 58 and may at least partially define an interior 50 of the knob 34. The projector support housing 54 may include a body 60 and a stem 62 projecting downwardly from the body 60. One portion of the body 60 may include a slit 64 to receive a portion of the light projector 42. One portion of the body 60 may further include at least one cylindrical hole 61. The projector support housing 54 may be mounted on the sub-housing 52, with the stem 62 projecting into the interior 50. The top cap 56 may include a top wall 66 and a side wall 68. The top wall 66 and the side wall 68 may be connected by a curved wall 70. One portion of the top cap 56 may include a slit 72 to receive a portion of the light projector 42. The slit 72 may be formed on at least the side wall 68. As illustrated, the slit 72 may be formed on the top wall 66 and curved wall 70 in addition to the side wall 68. The top cap 56 may be mounted on the sub-housing 52 and may overlie a portion of the projector support housing 54. As illustrated, when assembled, the top cap 56 may substantially cover the projector support housing 54 such that the body 60 is not visible. A spring 84 may be coupled with the stem 62 to permit the knob 34 to rotate relative to the panel 32.

The light projector 42 may include an illumination device 74 that emits light forming a beam of light and an optical element 48 coupled with the illumination device 74 to form the light emitted from the illumination device 74 into a beam of light, which may be focused or not. The beam of light may also be collimated, converging, or diverging. When the beam is focused, the focal point of the beam may lie just in front of or behind the upper surface of the panel 32. The location of the focal point may be selected to control the size of the projection of light.

The optical element 48 may be an element that alters the path of light rays passing through a portion of the element. Exemplary optical elements 48 may include a lens or a collimator, or may be a combination of both as a collimating lens. The optical element 48 may be at least partially formed of a translucent material and/or a transparent material. For example, the optical element 48 may be formed of glass or a plastic material.

As illustrated, the optical element 48 may include a lens 76 having a first transmission area 78 and a second transmission area 80. Both transmission areas permit the transmission of light from the illumination device 74 exteriorly of the housing 46. As such, the first and second transmission areas 78, 80 may be formed from a translucent or transparent material. The first transmission area 78 may include at least one curved portion 81. When the optical element 48 is assembled to the housing 46, the first and second transmission areas 78, 80 are generally aligned with the slit 72, with the first transmission area 78 aligned along the side wall 68 and the second transmission area aligned along the top wall 66. The optical element 48 may further include at least one branch 83 having the shape of a cylinder that may be received by the cylindrical hole 61 formed on the body 60 of the projector support housing 54. While the optical element 48 is shown as being a separate piece from the housing 46, in another embodiment, the optical element 48 could be integrated with the housing 46.

The illumination device 74 may include a light source 82. The light source 82 may be a source of the beam of light that spatially propagates, and may include a light emitting diode (hereafter referred to as "LED"), a laser or a lamp. The light source 82 may be located within the interior 50 of the housing 46. As illustrated, the light source 82 may be coupled with the stem 62 of the projector support housing 54 and may emit light toward the lens 76 of the optical element 48. The light source 82 may be configured to selectively emit light having at least one visible color. The light source 82 may be operably coupled with a spring 84 by an electrical conductor 86. The spring 84 may comprise an electrically conducting material such as metal or metallic alloy. The electrical conductor 86 may include one of an electrical wire, connectors, and switches.

Figure 4:
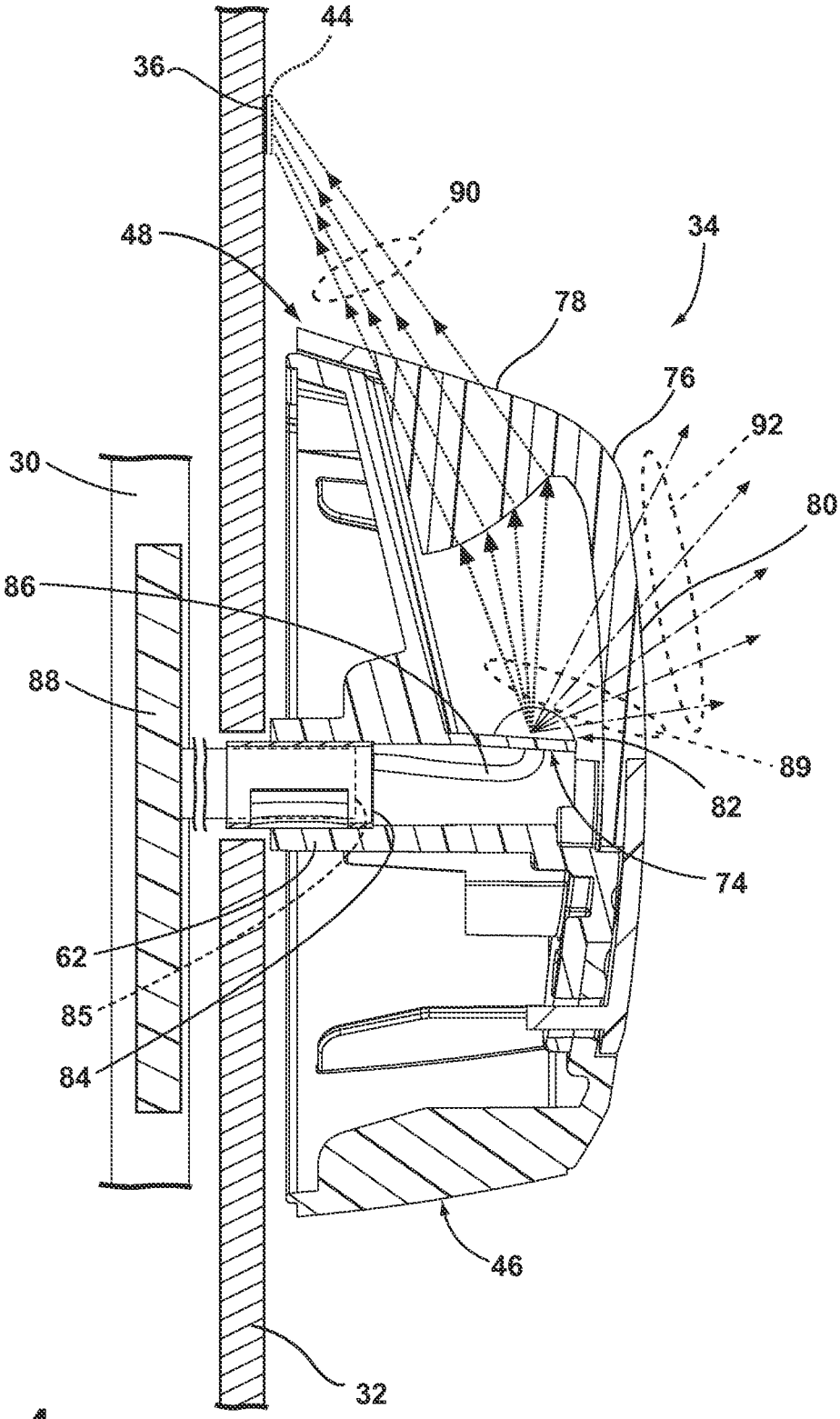
FIG. 4 is a cross-sectional view of the parameter selector taken along line IV-IV of FIG. 2 according to a first embodiment of the invention.

FIG. 4 is a cross-sectional view of the parameter selector or knob 34 taken along line IV-IV of FIG. 2 according to a first embodiment of the invention, wherein a path of the beam of light 89 emitted by the illumination device 74 is schematically illustrated. The stem 62 of the knob 34 may be coupled with the spring 84. The spring 84 may be coupled with the shaft 85. The shaft 85 may be rotatable and integrated with the controller 30 to permit the knob 34 to rotate relative to the panel 32. As illustrated, the light source 82 may be operably coupled with a spring 84 by the electrical conductor 86. The spring 84 may be operably coupled with the shaft 85 wherein at least part of the shaft 85 may comprise a conducting material such as metal or metallic alloy, or the spring 84 may be coupled with the shaft 85 by the electrical conductor 86. The shaft 85 may then be operably coupled with the controller 30 having at least one unit of printed circuit board 88 (hereafter referred to as "PCB").

When the user rotates the knob 34 to select one of the multiple indicia 36 formed on the surface of the panel 32, the illumination device 74 and the optical element 48 are also rotated. The light source 82 may emit the beam of light 89. The beam of light 89 emitted from the light source 82 may propagate spatially and a portion of the beam of light may pass through the optical element 48. As illustrated, a first portion 90 of the beam of light may pass through the first transmission area 78 of the lens 76 and a second portion 92 of the beam of light may pass though the second transmission area 80 of the lens 76. The first portion 90 of the beam of light may form the projection of light 44 on the surface of the panel 32 adjacent to the knob 34. The lens 76 may have a predetermined focal point that is adjacent the panel 32. More specifically, the focal point of the lens 76 may be one the panel 32, or may be beyond the panel 32 or in front of the panel 32. Therefore, the projection of light 44 may have varying dimension, size or edge sharpness. Rotation of the knob 34 will change the position of the projection of light 44 on the panel 32. The second portion 92 of the beam of light may pass to the exterior of the knob 34 without alternation of the path of light by the second transmission area 80. As a result, the second transmission area 80 may be luminous from the beam of light emitted from the light source 82 and may create a glowing effect on the knob 34 to further provide the user with information about the location of the knob 34 and the user-selectable parameters, even in the absence of an ambient light.

The light source 82 may be controlled to be triggered on when the knob 34 is rotated. Thereafter, the light source 82 may be kept on for a predetermined period of time, such as the length of a cycle of operation. When the cycle of operation is completed, the light source 82 may be turned off to preserve service life and save energy.

Figure 5:
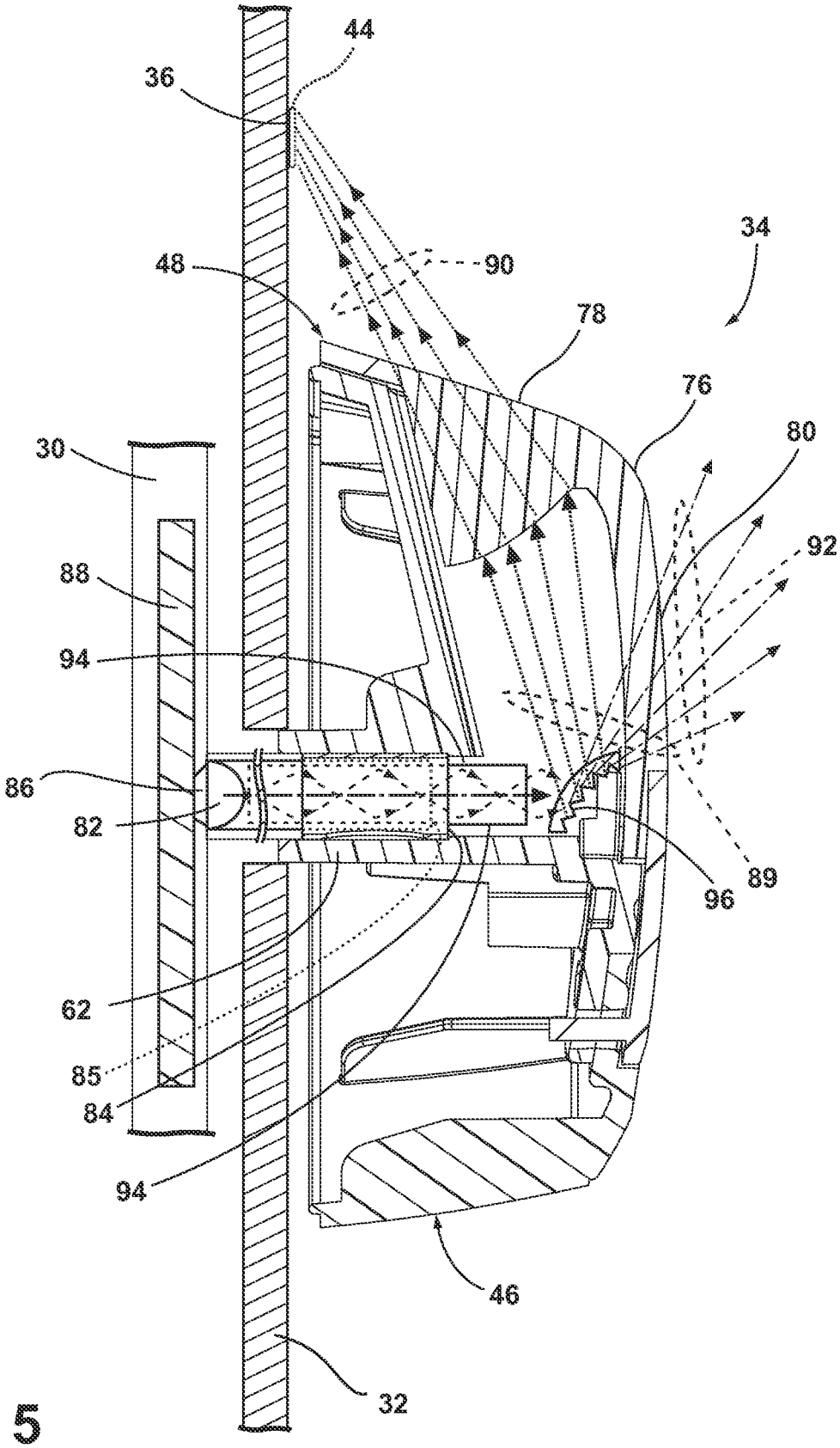
FIG. 5 is a cross-sectional view, similar to FIG. 4, of a parameter selector according to a second embodiment of the invention.

FIG. 5 is a cross-sectional view, similar to FIG. 4, of a parameter selector 34 according to a second embodiment of the invention, wherein elements in common with the first embodiment are referred to with the same reference numerals. In this embodiment, the light source 82 may be positioned at least partially with the controller 30 rather than the parameter selector 34. As illustrated, the light source 82 may be coupled with the PCB 88 that may be positioned adjacent to the surface of the panel 32. The stem 62 may include a light conduit 94 that may optically couple the light source 82 to control the path of the light emitted from the light source 82. The light conduit 94 may be optically coupled with at least one reflective element 96 that may be positioned within the housing 46 of the knob 34. The reflective element 96 may be formed of at least one mirror element having a predetermined shape and geometry that can reflect the beam of light 89 emitted from the light source 82 in predetermined directions.

The beam of light 89 emitted from the light source 82 may travel in the light conduit 94 prior to reaching to the reflective element 96. The reflective element 96 may optically guide and spatially propagate the beam of light 89 emitted from the light conduit 94. Once the beam of light 89 is guided out of the light conduit 94 by the reflective element 96, it may be received by the first transmission area 78 and the second transmission area 80 of the optical element 48 in a manner similar to that described above for FIG. 4 to form the discrete projection of light 44 on the surface of the panel 32 and to create a glowing effect on the knob 34.

Figure 6:
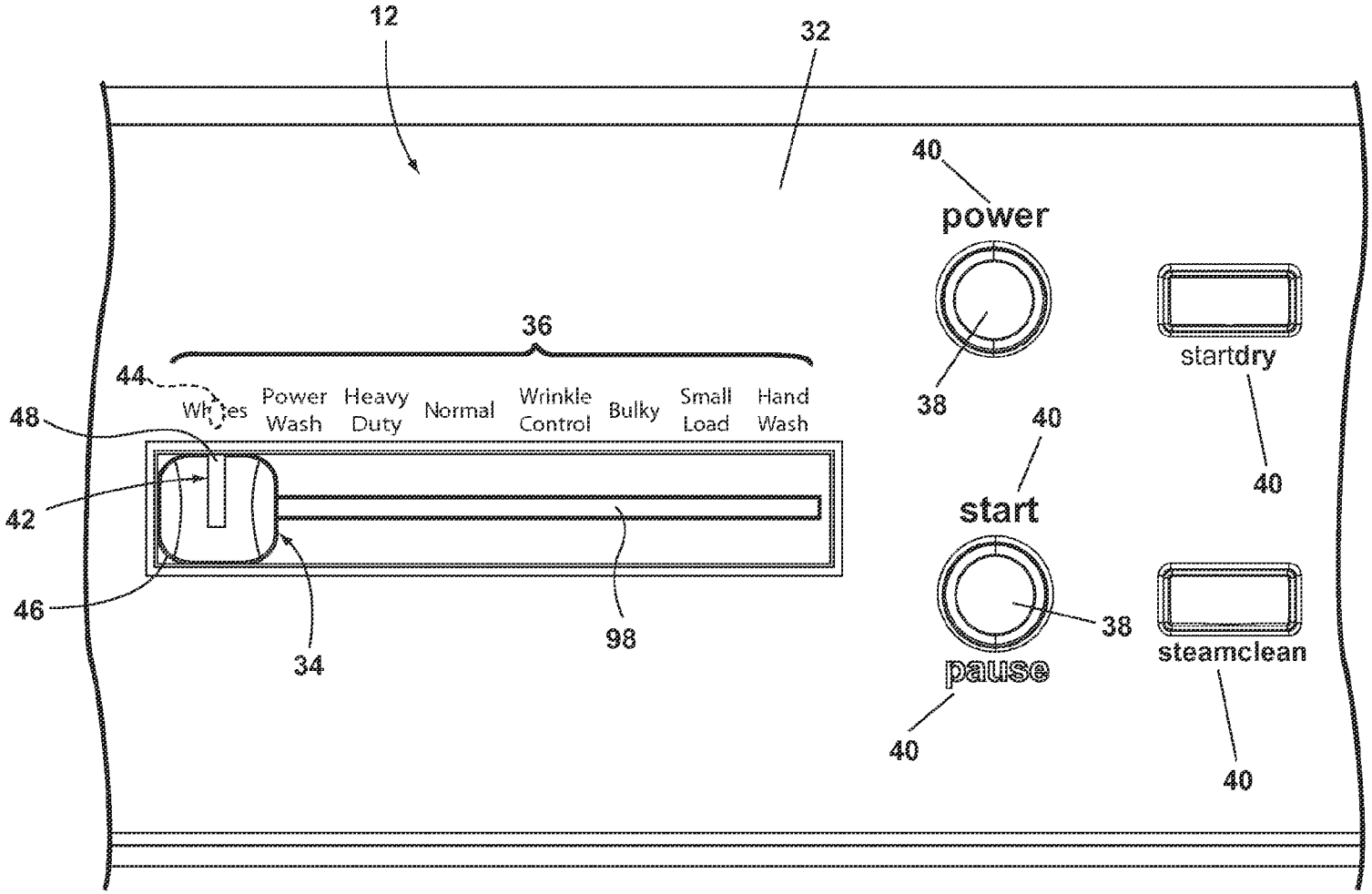
FIG. 6 is a front perspective view of the parameter selector slidable relative to the panel.

FIG. 6 is a front perspective view a third embodiment of a parameter selector 34, which is slidable relative to the panel 32, wherein elements in common with the first and second embodiment are referred to with the same reference numerals. Instead of rotating relative to the panel 32, parameter selector 34 may slide in one of opposite directions along a channel 98 formed on the panel 32 to select one of the multiple indicia 36 arranged on one side of the parameter selector 34. In the third embodiment, the projection of light 44 will slide along the indicia 36 and illuminate the indicia 36 corresponding to the selected parameter.

It is possible to combine the sliding and rotating movement of the first and third embodiments into a single selector.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A user interface for a controller, comprising:

a panel having multiple indicia representing a user-selectable parameter;

a knob configured to protrude from the panel and movable about a central axis relative to the multiple indicia; and a light projector comprising:

an illuminating device below the panel;

a light conduit located along the central axis and optically coupled to the illumination device to carry light from the light source along the central axis;

a reflector located within the knob and optically coupled to the light conduit to reflect the carried light; and a lens located on the knob and optically coupled to the reflector to project the reflected carried light as converging beam of light downwardly onto the panel to form a discrete spot of light on the panel;

wherein the discrete spot of light is in physical proximity with the multiple indicia such that movement of the knob relative to the multiple indicia causes a corresponding movement of the discrete spot of light, and the spot of light indicates which of the multiple indicia is selected by the knob.

2. The user interface of claim 1 wherein the light projector emits a focused beam of light.

3. The user interface of claim 2 wherein the focused beam of light has a focal point that is one of beyond the panel, on the panel, and in front of the panel.

4. The user interface of claim 1 wherein the illumination device comprises a light source.

5. The user interface of claim 4 wherein the illumination device further comprises a light conduit optically coupled with the light source to control the path of the light emitted from the light source.

6. The user interface of claim 4 wherein the light source is provided with one of the knob and the panel.

7. The user interface of claim 2 wherein the light projector further comprises an optical element optically coupled with the illumination device to form the light emitted from the illumination device into a focused beam of light.

8. The user interface of claim 7 wherein the optical element comprises the lens.

9. The user interface of claim 8 wherein the lens has a focal point adjacent the panel.

10. The user interface of claim 7 wherein the optical element further comprises a collimator.

11. The user interface of claim 1 wherein the knob comprises at least one of a rotating knob and a slidable knob.

12. A knob for a control panel, comprising:

a housing at least partially defining an interior;

an illumination device located at least partially within the interior and configured to emit light;

a first transmission area provided in the housing to permit the transmission of light from the illumination device to an exterior of the housing;

a lens optically coupled to the first transmission area to project received light as a converging beam of light through the first transmission area onto the panel to form a discrete spot of light on the panel;

a reflector located within the knob and optically coupled to the lens to reflect received light to the lens; and a light conduit located within the housing and optically coupled to the illumination device to carry light from the light source to the reflector;

wherein light emitted by the illuminating device is carried by the light conduit to the reflector, which reflects the carried light to the lens, which focuses the light into the beam of light that passes and forms a discrete spot of light on the control panel with a focal point at a predetermined distance from the knob, and the discrete spot of light is in physical proximity with the multiple indicia such that movement of the knob relative to the multiple indicia causes a corresponding movement of the discrete spot of light, and the spot of light indicates which of the multiple indicia is selected by the knob.

13. The knob of claim 12, further comprising a second transmission area through which the light from the illumination device may pass to the exterior of the housing.

14. The knob of claim 13 wherein at least one of the first and second transmission areas is one of translucent or transparent.

15. The knob of claim 13 wherein the housing comprises a side wall and a top wall, with the first transmission area located in the side wall and the second transmission area located in the top wall.

16. The knob of claim 13 wherein the first transmission area, second transmission area, and optical element are integrated with the housing.

17. The knob of claim 12 wherein the illumination device comprises a light source located within the interior.

18. The knob of claim 12 wherein the lens comprises one of a lens having a predetermined focal point and a collimator.

19. The knob of claim 12 wherein the knob comprises one of a rotatable knob and a slidable knob.

* * * * *